United States Patent [19]

Poloff et al.

[11] Patent Number: 4,793,034

[45] Date of Patent: Dec. 27, 1988

[54] METHOD OF MANUFACTURING KNIT BODY GARMENTS

[75] Inventors: Dennis E. Poloff, Fayetteville; Robert M. Simpkins, Weaverville; Garlen R. Farley, Fayetteville, all of N.C.

[73] Assignee: Stevcoknit Fabrics Co., Greenville, S.C.

[21] Appl. No.: 88,075

[22] Filed: Aug. 21, 1987

[51] Int. Cl.[4] ..... D04B 1/24

[52] U.S. Cl. ..... 28/153; 28/218; 66/172 R; 66/176; 66/200

[58] Field of Search ..... 28/153, 218; 66/8, 64, 66/172 R, 176, 175, 125 A, 200

[56] References Cited

U.S. PATENT DOCUMENTS 3,466,718 9/1969 Adamson ..... 28/218 X
3,828,405 8/1974 DeVinney ..... 28/218
4,033,717 7/1977 Whitaker ..... 28/218 X

FOREIGN PATENT DOCUMENTS 2073786 10/1981 United Kingdom ..... 66/8

*Primary Examiner*—Wm. Carter Reynolds
*Attorney, Agent, or Firm*—Bell, Seltzer, Park & Gibson

[57] ABSTRACT

Knit sport shirts and the like characterized by having the body portion and the trim of exactly the same color shade are manufactured by circularly knitting the same type of yarn to form first and second tubular fabrics and then simultaneously dyeing both the first and second tubular fabrics together to obtain the same color in both fabrics. The second tubular fabric is unraveled and the unraveled yarn is used in knitting the trim on a flat knitting machine. The first tubular fabric is cut and sewn to form the body blank and the knit trim is attached to the body blank to complete the sport shirt.

14 Claims, 2 Drawing Sheets

METHOD OF MANUFACTURING KNIT BODY GARMENTS

FIELD OF THE INVENTION

This invention relates generally to a method of manufacturing knit body garments, such as sport shirts and the like, having a main body portion with knit trim, such as a collar, cuffs, and/or a welt, usually formed of rib knit fabric, and more particularly to a method of manufacturing this type of garment which is characterized by having the body portion and the trim of exactly the same shade of color.

BACKGROUND OF THE INVENTION

In the manufacture of sport shirts and the like it is the usual practice to circularly knit tubular fabric for use in forming the body and sleeve portions and to dye this circular knit fabric to obtain a particular color shade. The knit trim, such as the collars, cuffs, and/or welts and the like, is normally knit with multiple ends of the same type of yarn but in a rib knit construction on a V-bed knitting machine with successive trim blanks being held together by a separator thread. Rolls of the trim fabric are usually dyed with the circular knit body fabric in an attempt to obtain the desired color shade in both the body fabric and the trim fabric. However, it is difficult to obtain exactly the sam color in both fabrics because the fabrics are knit with different stitch constructions, the trim fabric is heavier than the body fabric, and the dye bath tends to shrink the fabrics differently. When sport shirts are manufactured in accordance with this conventional method, it is not unusual to reject about 20% of the sport shirts because the dyed color of the trim does not exactly match the dyed color of the body of the shirt.

In an attempt to overcome this high rejection rate, sport shirts and the like have been manufactured by a yarn dye process. In this process, yarn packages of both the yarn from which the body and sleeve portions is to be knit and the yarn from which the trim is to be knit are dyed together in the same dye bath. It is difficult to obtain the exact same color yarn from outside to inside of wound yarn packages. Even when the body fabric and the trim fabric are both knit from yarns which have been dyed together, they may appear to be of a different color because the trim fabric is knit of multiple ends of the yarn and is knit in a different stitch construction.

SUMMARY OF THE INVENTION

In contrast to the above, knit sport shirts and the like manufactured in accordance with the method of the present invention are characterized by having the body portion and he trim of the same identical shade of color.

The same shade of color is obtained in the body and the trim of the sport shirt by circularly knitting yarn and forming a first tubular fabric adapted to form the body and sleeve portions of the sport shirt, and circularly knitting multiple ends of the same type of yarn and forming a second tubular fabric. Both the first and second tubular fabrics are then simultaneously dyed together to obtain exactly the same color shade in both fabrics. The yarn from the dyed second tubular fabric is then unraveled and knit in a rib knit construction on a flat knitting machine to form the trim while the first dyed tubular fabric is cut and sewn to form the body and sleeves of the sport shirt. The knit trim is then attached to the body of the sport shirt so that both the body portion and the trim are of exactly the same color shade.

In accordance with the present invention, the first tubular fabric adapted to form the body and sleeves is preferably knit on a large circular multiple feed knitting machine while the second tubular fabric adapted to form the knit trim is first knit on a large circular single feed knitting machine. The second tubular fabric is knit of multiple ends of yarn which are twisted together as the yarn is fed to the knitting machine to facilitate unraveling of the second tubular knit fabric. The yarn from the dyed second tubular fabric is unraveled and may be wound onto supply cones in a back winding operation for use on the flat knitting machine for knitting the trim. Alternatively, the yarn from the dyed second tubular fabric may be unraveled and directly fed to the trim knitting machine to eliminate the back winding operation.

BRIEF DESCRIPTION OF THE DRAWINGS

Other objects and advantages will appear as the description proceeds when taken in connection with the accompanying drawings, in which.

DESCRIPTION OF PREFERRED EMBODIMENT

Figure 1:
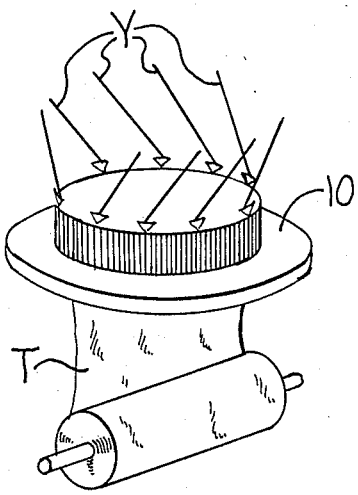
FIG. 1 is a schematic isometric view illustrating the manner in which the first tubular fabric is knit on a multiple feed circular knitting machine.

As illustrated in the drawings, a preferred method of manufacturing sport shirts in accordance with the present invention includes circularly knitting a plurality of single yarn ends Y on a circular knitting machine, indicated at 10 in FIG. 1, and forming a first tubular fabric, indicated at T, of the proper diameter and length to form body blanks and sleeves therefrom. It is preferred that the tubular fabric T be knit on a large diameter multi-feed circular knitting machine having a single set of needles and the body fabric is usually knit with plain jersey stitch loops. The first tubular fabric T is taken up in a roll on the machine in the conventional manner, as indicated in FIG. 1.

Figure 2:
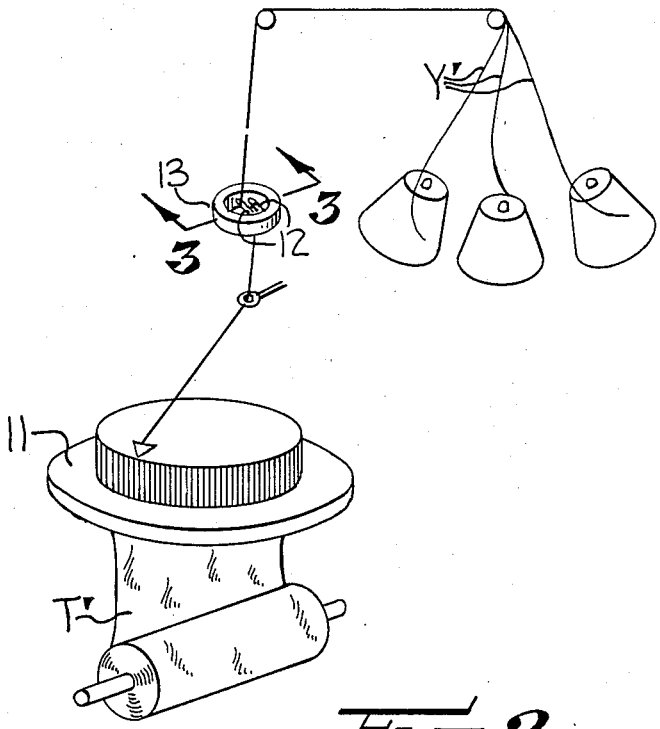
FIG. 2 is a view similar to FIG. 1 but showing the manner in which multiple yarn ends are twisted together and knit on a single feed circular knitting machine to form a second tubular fabric adapted to form the knit trim therefrom.

As shown in FIG. 2, three ends of the same type of yarn, indicated at Y′, are simultaneously circularly knit on a large circular single feed knitting machine, indicated at 11, to form a second tubular fabric T′. The knitting machine 11 is also provided with a single set of needles and the second tubular fabric T' is knit with plain jersey stitch loops. The second tubular fabric T' is taken up in a roll form on the knitting machine in the conventional manner. The individual yarns Y used in knitting the first tubular fabric T are of the same type and size each of as the yarn ends Y' used in knitting the second tubular fabric T'. To facilitate later unraveling, the three ends of yarn Y' are passed under and over transverse twist pins 12 (FIG. 3) supported across the central opening in a rotated friction twisting ring 13 supported on the upper portion of the knitting machine 11. The rotated friction twisting ring 13 acts as a false twister on the yarns to insure that the same length of each of the yarn ends Y' is incorporated in the second tubular fabric T'. The three ends of the yarn Y' are twisted together as they are fed to the needles and knit to form the second tubular fabric T'.

Figure 3:
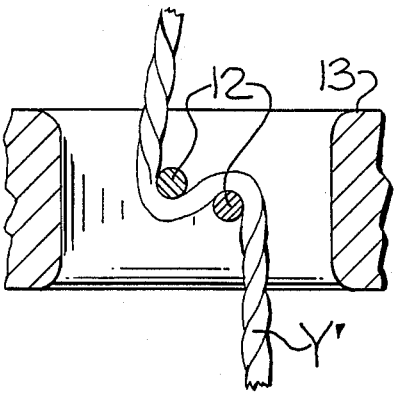
FIG. 3 is a fragmentary sectional view through the yarn twisting device, taken substantially along the line 3—3 in FIG. 2.

Rolls of both the first tubular knit fabric T and the second tubular knit fabric T' are simultaneously dyed in a conventional type of dye kettle, as indicated at 20 in FIG. 3. Since both the first tubular fabric T and the second tubular fabric T' are knit of the same type of stitch construction and both fabrics are knit of the same yarn, except that the second tubular fabric T' is knit of three ends of yarn, both tubular fabrics T and T' are dyed to exactly the same color shade.

The yarn from the dyed second tubular fabric T' is then unraveled and may be wound onto supply cones, in a conventional back winding operation not shown, and the supply cones may then be used as the supply cones for knitting the trim on a flat knitting machine. However, it is preferred that the dyed second tubular fabric T' be unraveled and fed directly to the flat knitting machine for forming the trim, in the manner illustrated in FIG. 4.

Figure 4:
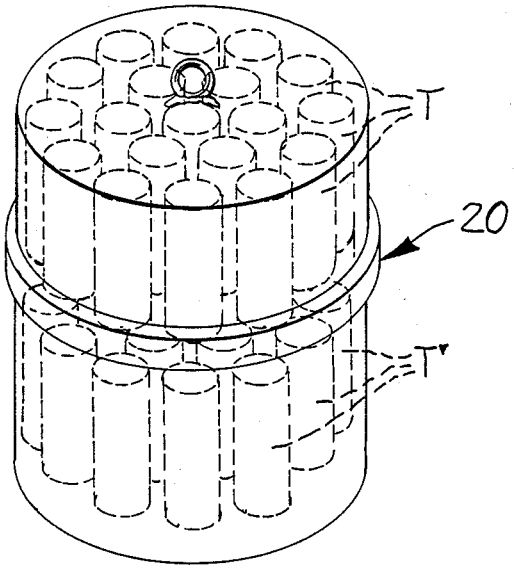
FIG. 4 is an isometric view of a dye kettle illustrating the manner in which both the first and second tubular fabrics are simultaneously dyed together to obtain exactly the same color shade in both fabrics.
Figure 5:
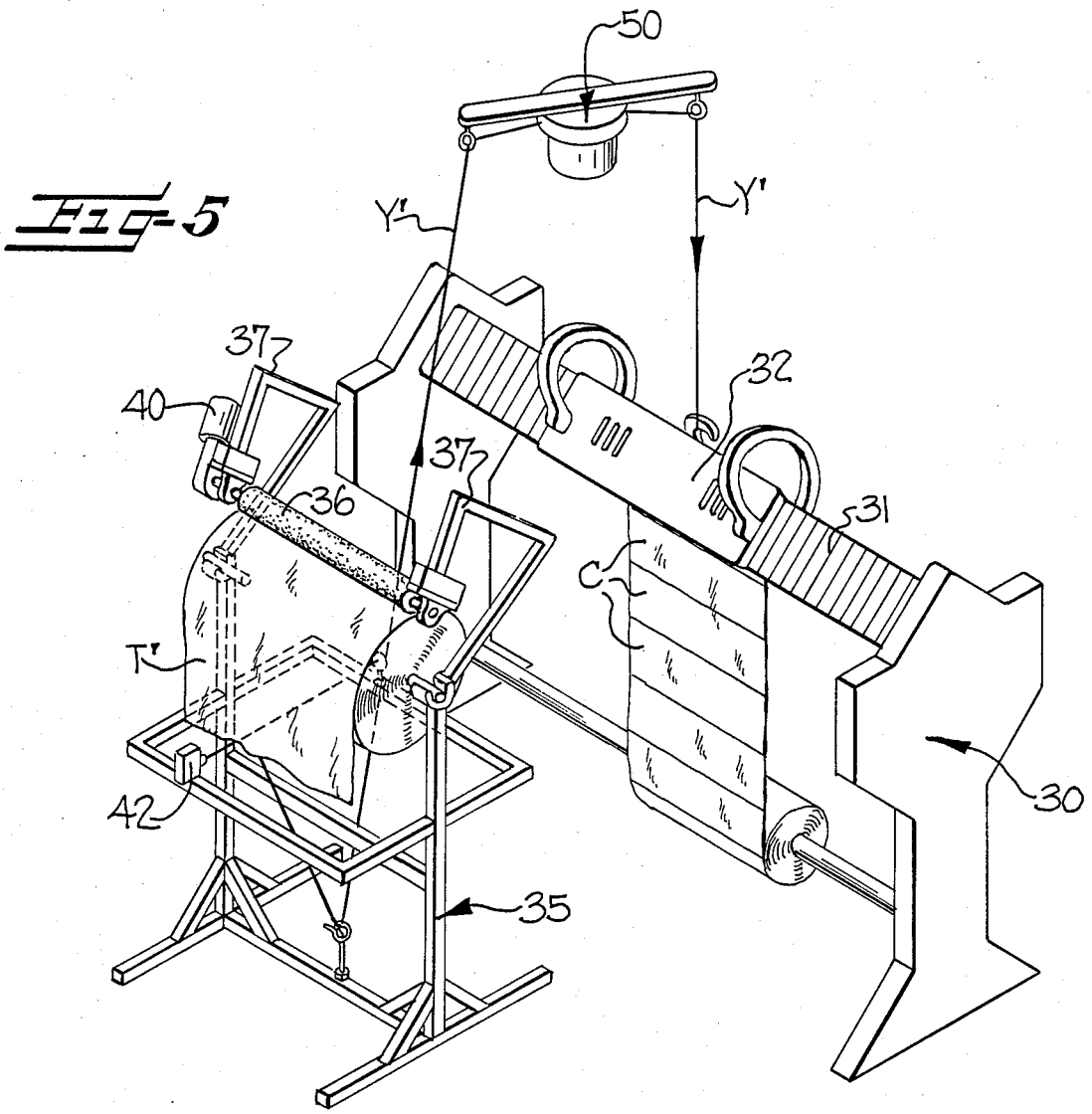
FIG. 5 is an isometric view of a flat V-bed type of knitting machine forming the trim for the sport shirt, and illustrating the manner in which the yarn is unraveled from the roll of dyed second tubular fabric and fed directly to the knitting machine.

The machine for knitting the trim is preferably of the flat V-bed type indicated broadly at 30 in FIG. 4. This machine 30 is provided with front and rear needle beds 31 extending from one side to the other and a traversing stitch cam carriage 32 is mounted for back and forth movement along the needle beds 31 to form a rib knit trim fabric. The machine 30 is illustrated producing successive collars, indicated at C, which are connected together in a conventional manner by alginate yarn or separator threads and the collars are taken up on a conventional take-up roll. The unraveled and dyed yarn Y' is supplied to the knitting machine 30 as it is directly and continuously unraveled from a roll of the dyed second tubular fabric T'.

The roll of dyed second tubular fabric T' is supported on a frame 35. The roll of deed second tubular fabric T' is rotated by a friction drive roll 36 bearing against the upper surface of the roll of dyed second tubular fabric T' and supported for rotation on the lower ends of pivot arms 37, the upper ends of which are pivotally connected to the frame 35. A drive motor 40 imparts rotation to the drive roll 36 to feed the lower free end of the second tubular fabric downwardly, as needed. The drive motor 40 is periodically operated by an electric eye 42 supported on the frame 35 and being operable to detect the position of the lower open edge of the dyed second tubular fabric T'.

The dyed yarn Y' is withdrawn and unraveled from the lower edge of the dyed second tubular fabric T' by a conventional yarn supply accumulator 50 supported on a bracket extending upwardly from the knitting machine 30. Thus, the yarn supply accumulator 50 draws and unravels the dyed yarn Y' from the lower edge of the dyed second tubular fabric T' and feeds the yarn Y' to the knitting machine 30 to form the successive collars C. The same type of machine 30 is utilized in knitting the other type of trim, such as cuffs, welts and the like, joining the same together by an alginate separator thread. The rolls of knit trim fabric are then unrolled and passed over a steam table so that the steam dissolves the alginate separator threads to separate the cuffs, collars, welts and the like.

Figure 6:
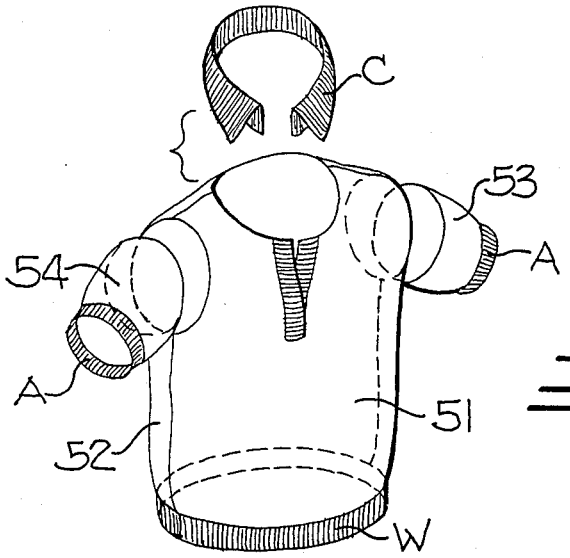
FIG. 6 is an exploded isometric view of a typical knit sport shirt manufactured in accordance with the present invention and illustrating the manner in which the trim is attached to the body and sleeves of the shirt.

The sport shirt is then completed by cutting and sewing the first dyed tubular fabric T to form the body blank, including a front panel 51 (FIG. 6), a rear panel 52 and sleeves 53, 54. A rib knit collar C is attached to the neck opening of the sport shirt and the lower end of the shirt may be provided with a rib knit welt W which is knit of the unraveled dyed yarn Y'. The lower ends of the sleeves 53, 54 may also be provided with rib knit cuffs A which are also knit of the unraveled and dyed yarn Y'. The sleeves 53, 54 are seamed and attached to the body of the sport shirt.

Since the unraveled yarn Y' of which the trim is knit, including the collar C, cuffs A and welt W, has been dyed while knit in the second tubular fabric and at the same time as the first tubular fabric was dyed, both yarns Y and Y' are dyed to exactly the same color shade. Thus, the completed sport shirt includes a body portion, with sleeves, which is exactly the same color shade as the knit trim attached thereto.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A method of manufacturing knit body garments, such as sport shirts and the like, having a main body portion and knit trim, such as collars, cuffs, welts and the like, and being characterized by having the body portion and trim of the same color, said method comprising the steps of circularly knitting yarn and forming a first tubular fabric of the proper diameter to form at least one body blank, circularly knitting the same type of yarn and forming second tubular fabric therefrom, simultaneously dyeing both said first and second tubular fabrics together to obtain the same color in both fabrics, unraveling the yarn from the dyed second tubular fabric, knitting the trim of the unraveled and dyed yarn from the second tubular fabric, cutting and sewing the first dyed tubular fabric and forming a body blank therefrom, and attaching the knit trim to the body blank.

2. A method according to claim 1 including the steps of knitting said first tubular fabric on a multi-feed circular knitting machine, and knitting said second tubular fabric on a single feed circular knitting machine.

3. A method according to claim 2 wherein said first tubular fabric is knit with a single end of yarn being fed at each feed of the multi-feed circular knitting machine, and wherein said second tubular fabric is knit with multiple ends of yarn being fed at the single feed of the circular knitting machine.

4. A method according to claim 3 including the step of twisting together the multiple ends of yarn being fed to the single feed of the circular knitting machine.

5. A method according to claim 1 wherein the unraveled yarn from the dyed second tubular fabric is fed to and knit on a flat knitting machine to knit the trim therefrom.

6. A method according to claim 5 wherein the yarn is unraveled from the dyed second tubular fabric and fed directly to the flat knitting machine to knit the trim therefrom.

7. A method according to claim 5 wherein the trim is knit on the flat knitting machine in a rib knit construction.

8. A knit body garment manufactured in accordance with the method of claim 1

9. A method of manufacturing knit sport shirts having a main body portion and knit trim, such as collars, and being characterized by having the body portion and trim of exactly the same color shade, said method comprising the steps of circularly knitting a first tubular fabric of the proper diameter and length to form a plurality of body blanks therefrom and while knitting a single end of yarn at each feed of a multi-feed circular knitting machine, circularly knitting the same type of yarn and forming a second tubular fabric while feeding multiple ends of the yarn at a single feed of a circular knitting machine, simultaneously dyeing both said first and second tubular fabrics together to obtain the same color in both fabrics, unraveling the yarn from the dyed second tubular fabric, knitting the trim of the unraveled and dyed yarn from the second tubular fabric, cutting and sewing the first dyed tubular fabric and forming a body blank therefrom, and attaching the knit trim to the body blank.

10. A method according to claim 9 including the step of twisting together the multiple ends of yarn being fed to the single feed of the circular knitting machine when knitting said second tubular fabric.

11. A method according to claim 10 wherein three ends of yarn are fed to the single feed of the circular knitting machine.

12. A method according to claim 9 wherein the unraveled yarn from the dyed second tubular fabric is fed to and knit with a rib construction on a flat knitting machine.

13. A method according to claim 12 wherein the yarn is unraveled from the dyed second tubular fabric and fed directly to the flat knitting machine to knit the trim therefrom.

14. A knit sport shirt manufactured in accordance with the method of claim 9.

* * * * *